US012359532B2

(12) United States Patent
Gray

(10) Patent No.: US 12,359,532 B2
(45) Date of Patent: Jul. 15, 2025

(54) ELECTRICALLY OPERATED LOW POWER COMPLETION CONTROL SYSTEM

(71) Applicant: Halliburton Energy Services, Inc., Houston, TX (US)

(72) Inventor: Matthew S. Gray, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/525,787

(22) Filed: Nov. 30, 2023

(65) Prior Publication Data

US 2025/0179893 A1 Jun. 5, 2025

(51) Int. Cl.
*E21B 34/06* (2006.01)

(52) U.S. Cl.
CPC ..... *E21B 34/06* (2013.01)

(58) Field of Classification Search
CPC ..... E21B 34/06
See application file for complete search history.

(56) References Cited

U.S. PATENT DOCUMENTS

2003/0192697 A1 10/2003 Grubb et al.
2004/0112642 A1* 6/2004 Krueger ..... E21B 21/08 175/57
2015/0060084 A1 3/2015 Moen et al.
2018/0274331 A1 9/2018 Richards et al.
2018/0283133 A1* 10/2018 Poluchalla ..... E21B 34/066

OTHER PUBLICATIONS

International Search Report and Written Opinion for PCT/US2023/083120, Aug. 27, 2024.

* cited by examiner

*Primary Examiner* — D. Andrews
(74) *Attorney, Agent, or Firm* — The Hilton Firm PLLC

(57) ABSTRACT

An example control system includes a hydraulic pump disposed in a wellbore, a valve bank disposed in the wellbore, and an unpressurized hydraulic fluid reservoir. The hydraulic pump is fluidically connected with the valve bank. The valve bank is fluidically connected with the unpressurized hydraulic fluid reservoir. The unpressurized hydraulic fluid reservoir is fluidically connected with the hydraulic pump. The control system is configured to flow pressurized hydraulic fluid exiting from the hydraulic pump to the valve bank to be distributed from the valve bank to the wellbore equipment.

16 Claims, 6 Drawing Sheets

ELECTRICALLY OPERATED LOW POWER COMPLETION CONTROL SYSTEM

TECHNICAL FIELD

The present disclosure relates generally to wellbore operations, and more particularly, to the use of a control system to operate wellbore equipment at any depth without the need for a hydraulic control line from the surface.

BACKGROUND

In a wellbore, it may be desirable to operate wellbore equipment, for example, to operate valves or other types of completions equipment in order to perform a wellbore operation. Some wellbore equipment may require hydraulic control lines for operation. These control lines may be impacted by the depth of operation, with very deep operations having a greater number of potential issues due to the increased pressures and temperatures commonly encountered at greater depths.

The control of wellbore equipment is an important part of a wellbore operation. The present invention provides improved control systems and methods for controlling wellbore equipment.

BRIEF DESCRIPTION OF THE DRAWINGS

Illustrative examples of the present disclosure are described in detail below with reference to the attached drawing figures, which are incorporated by reference herein, and wherein.

Figure 1:
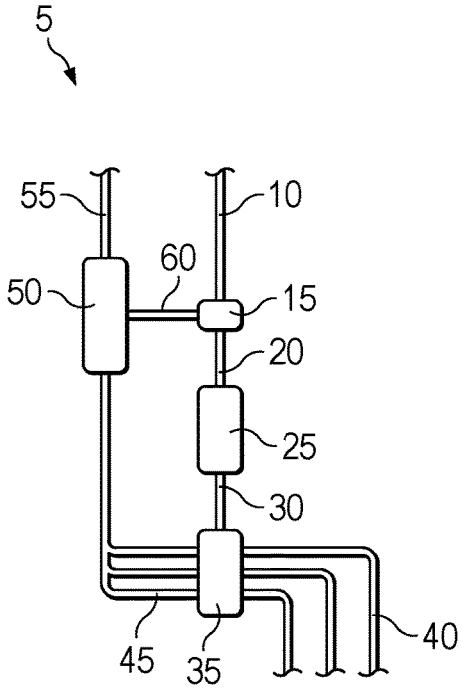
FIG. 1 is a schematic of an example control system in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates generally to wellbore operations, and more particularly, to the use of a control system to operate wellbore equipment at any depth without the need for a hydraulic control line from the surface.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component. The term uphole is inclusive of components disposed on the wellsite surface.

The present disclosure relates generally to wellbore operations, and more particularly, to the use of a control system to operate wellbore equipment at any depth without the need for a hydraulic control line from the surface. Advantageously, the control system provides a supply of hydraulic pressure to operate wellbore equipment such as interval control valves, safety valves, and other types of completions equipment. Moreover, this control system utilizes only a single electrical power line from the surface and does not require a hydraulic control line from the surface to supply hydraulic pressure to the wellbore equipment. The control system may be used to selectively operate multiple pieces of wellbore equipment. An additional advantage is that the control system may optionally comprise an accumulator to hold pressurized hydraulic fluid for future use. The components of the control system may be sized and located in multiple places in the wellbore so as to provide an idealized setup to meet a desired well function. Further, the control system comprises multiple optional components which may be added or removed to the control system as desired to increase or decrease functionality based on the needs of the desired well operation. One more advantage is that the system possess modularity and its various components may be rearranged or shifted across multiple well zones as desired and also so as to operate multiple pieces of wellbore equipment in varying locations of the wellbore. The control system uses a low power electrical connection and does not require a hydraulic control line from the surface, thereby increasing the robustness of the system and removing potential issues which may be encountered from surface control systems which may be reliant on supplying hydraulic pressure from the surface in order to control wellbore equipment.

FIG. 1 is a schematic illustrating an example control system, generally 5. Control system 5 is an illustration of a default example control system which comprises every component, including every optional component, which may be used with the control systems disclosed herein. In later examples, some of these optional components may be absent. The control system 5 may be disposed, in its entirety, in any wellbore zone. Such wellbore zones may be, for example, between a tubing hanger and safety valve, between a safety valve and a production packer, downhole of the production packer, or between each interval control valve. Alternatively, the various components of the control system 5 may be organized and subdivided into discreet groups with each grouping present in a different wellbore zone. Additional alternatives may also be present, such as where multiple control systems 5 are disposed in different wellbore zones and may be coupled to one another to link the control systems 5 across these different wellbore zones.

With continued reference to FIG. 1, control system 5 may be used to operate wellbore equipment disposed within a wellbore. The control system 5 may be disposed on a wellbore tubular (not pictured for clarity of illustration) or any type of wellbore conduit disposed in the wellbore. One component of the control system 5 is a tubing encapsulated conductor 10. The tubing encapsulated conductor 10 is an electrical line that descends from the surface and provides power to the control system 5. The control system 5 is a low power device and as such, any tubing encapsulated conductor 10 sufficient to meet the power requirements of the control system 5 may be used. Additionally, the tubing encapsulated conductor 10 is encapsulated to protect the tubing encapsulated conductor 10 from increasing pressure as it descends in the wellbore as well as from environmental hazards in the wellbore. The tubing encapsulated conductor 10 is affixed to and runs along the length of the wellbore tubing or other such conduit. It is to be understood, that although FIG. 1 describes the electrical line as a tubing encapsulated conductor 10, it is not strictly necessary for the tubing encapsulated conductor to be encapsulated and some unencapsulated electrical lines may be used in some examples. Additionally, the tubing encapsulated conductor may not be affixed to the tubing in some examples and may be conveyed down the length of the wellbore through other conveyances.

The tubing encapsulated conductor 10 is coupled to a hydraulic pump 15. The hydraulic pump 5 is powered by the electricity conveyed by the tubing encapsulated conductor 10. The hydraulic pump 15 increases the pressure of hydraulic fluid conveyed to the hydraulic pump 15. The hydraulic pump 15 pressurizes this hydraulic fluid for the operation of downstream wellbore equipment via a valve bank 35, the operation of which is described in detail below. Any sufficient type of hydraulic pump may be used for hydraulic pump 15 as would be readily apparent to one of ordinary skill in the art. The hydraulic pump 15 may be selected based on its dimensions and functionality such that it is able to provide an adequate volume of sufficiently pressurized hydraulic fluid to the valve bank 35 and to be configurable to interface with the other components of control system 5. A high pressure output line 20 may be coupled to the downstream exit end of the hydraulic pump 15, thereby fluidically connecting the hydraulic pump 15 to the high pressure output line 20 allowing for the flow of pressurized hydraulic fluid from the hydraulic pump 15 to and through the high pressure output line 20. The high pressure output line 20 may be any conduit configured to convey pressurized hydraulic fluid from the hydraulic pump 15 to the valve bank 35. The high pressure output line 20 should be manufactured such that it can resist external pressure and be capable of conveying hydraulic fluid of a desired pressure from the hydraulic pump 15 to any downstream component. In some examples, which are discussed in greater detail below, the high pressure output line 20 may be eliminated from the control systems described herein and a downstream component may be directly coupled to and fluidically connected with the hydraulic pump 15 without an intervening line or other separate connecting component.

As illustrated in FIG. 1, the high pressure output line 20 is connected to an accumulator 25. The accumulator 25 may be used to hold the pressurized hydraulic fluid provided from the hydraulic pump 15. In some examples, the accumulator 25 may be directly coupled to and fluidically connected to the hydraulic pump 15 without an intervening line or separate connecting component. The accumulator 25 may be used to store large volumes of pressurized hydraulic fluid for future use by downstream wellbore equipment. The accumulator 25 comprises a space for storage of the pressurized fluid. Some examples of the accumulator 25 may comprise a bladder for storage or any other such expandable container. In some examples, a high pressure output line, such as high pressure output line 20 may function as the accumulator for the control system 5 and may store a sufficient volume of pressurized fluid until used by the valve bank 35 as discussed below. Some of the examples of the accumulator 25 may include mechanisms such as gas charges or mechanical springs to provide pressure compensation to the accumulator 25 such that it is able to maintain a stable rate of depletion of a large volume of the pressurized hydraulic fluid. In some examples, the accumulator 25 is not used and the pressurized hydraulic fluid is transferred directly to the valve bank 35. High pressure output line 30 is another high pressure output line, and is coupled to the downstream exit side of the accumulator 25. The high pressure output line 30 may be any conduit configured to convey pressurized hydraulic fluid from the accumulator 25 to the valve bank 35. The high pressure output line 30 should be manufactured such that it can resist external pressure and be capable of conveying hydraulic fluid of a desired pressure from the accumulator 25 to the valve bank 35. In some examples, which are discussed in greater detail below, the high pressure output line 30 may be eliminated from the control systems described herein and the valve bank 35 may be directly coupled to and fluidically connected with the hydraulic pump 15, the accumulator 20, or the high pressure output line 20 without any intervening lines or other separate connecting components. As discussed, the high pressure output line 30 conveys pressurized hydraulic fluid from the accumulator 25 to the valve bank 35. In examples where the accumulator 20 is absent, the high pressure output line 30 will also be absent and the downstream valve bank 35 may be coupled directly to and fluidically connected with the hydraulic pump 15. Alternatively, the valve bank 35 may be coupled directly to and fluidically connected with the high pressure output line 20 exiting from the hydraulic pump 15 such that the high pressure output line 20 functions as an accumulator as well as the intervening connection component between the hydraulic pump 15 and the valve bank 35.

With continued reference to FIG. 1, the valve bank 35 is downstream of the hydraulic pump 15 and receives the pressurized hydraulic fluid from the hydraulic pump 15. As discussed above, this pressurized hydraulic fluid may be received directly from the hydraulic pump 15, or through any of or any combination of the high pressure output line 20, the accumulator 25, and/or the high pressure output line 30. The valve bank 35 directs the pressurized hydraulic fluid to one or more pieces of downstream wellbore equipment. The downstream wellbore equipment can be operated independently by the valve bank 35. The valve bank 35 comprises at least one valve which may be operated to apply pressurized hydraulic fluid directly to the downstream wellbore equipment, block in pressure to the downstream wellbore equipment, and/or vent pressure out of the valve bank 35 by expelling the pressurized hydraulic fluid. If the downstream wellbore equipment is blocked in, the valve bank 35 will supply sufficient pressurized hydraulic fluid to the wellbore equipment through the valve so as to actuate or operate the downstream wellbore equipment and then seal this corresponding valve of the valve bank 35. The sealed valve blocks in the pressurized hydraulic fluid and leaves the wellbore equipment in the "on" or actuated state. The valve bank 35 may comprise a series of valves which may be independently opened or closed so as to provide the pressurized hydraulic fluid to one or more pieces of wellbore equipment independently.

Continuing with FIG. 1, a control line 40 is affixed to one of the exit ports of the valve bank 35. In the illustrated example, there are three control lines 40, but it is to be understood that any number of control lines 40 may be used by the valve bank 35, for example, less than or more than three control lines 40 may be used. Each of the control lines 40 connects to a piece of wellbore equipment. In some optional examples, multiple control lines 40 may connect to the same piece of downstream wellbore equipment so as to provide different operational functionality based on which control line is pressurized with hydraulic fluid. As discussed above, the valve bank 35 is configured to independently direct the pressurized hydraulic fluid to any of the control lines 40 via operation of the corresponding valve of the valve bank 35. In some optional examples, the control system 5 does not use any control lines 40 and the downstream wellbore equipment is directly coupled to the valve bank 35 without any intervening lines or separate connecting components. The control lines 40 may comprise any conduit configured to convey pressurized hydraulic fluid from the valve bank 35 to the downstream wellbore equipment. The control lines 40 should be manufactured such that they can sufficiently resist external pressure and be capable of conveying hydraulic fluid of a desired pressure from the valve bank 35 to any downstream wellbore equipment. In some examples, which are discussed in greater detail below, the control lines 40 may be eliminated from the control systems described herein and some or all of the downstream wellbore equipment may be directly coupled to and fluidically connected with the valve bank 35 without an intervening line or other separate connecting component.

The exhaust lines 45 is a fluid line directed to vent hydraulic fluid from the valve bank 35. The vented hydraulic fluid may exit one or more exit ports provided on the valve bank 35 as desired by the operator. The exhaust lines 45 are coupled to the unpressurized fluid reservoir 50. The exhaust lines 45 may comprise any conduit configured to convey hydraulic fluid from the valve bank 35 to the unpressurized fluid reservoir 50. The exhaust lines 45 should be manufactured such that they can sufficiently resist external pressure and be capable of conveying hydraulic fluid from the valve bank 35 to the unpressurized fluid reservoir 50. In some examples, which are discussed in greater detail below, the exhaust lines 45 may be eliminated from the control systems described herein and the unpressurized fluid reservoir 50 may be directly coupled to and fluidically connected with the valve bank 35 without an intervening line or other separate connecting component.

With continued reference to FIG. 1, the unpressurized fluid reservoir 50 is a reservoir for storing the vented hydraulic fluid from the valve bank 35. In some optional examples, the unpressurized fluid reservoir may be directly coupled to the valve bank 35 without the use of exhaust lines 45 or any other intervening lines or separate connecting components. The unpressurized fluid reservoir 50 may store the hydraulic fluid until it is used by the hydraulic pump 15. The unpressurized fluid reservoir 50 may be any vessel sufficient for storing the hydraulic fluid and should also be able to resist external pressure as may be encountered in some wellbore environments. In some optional examples, an optional fluid replenishment line 55 may be used to replenish hydraulic fluid to the unpressurized fluid reservoir 50. This optional fluid replenishment line 55 may descend from the surface or any upstream fluid reservoir or vessel and be used to supply hydraulic fluid to the unpressurized fluid reservoir 50 should the supply of hydraulic fluid run low. In other examples, the control system 5 is a closed system and there is no external supply of hydraulic fluid introduced. Connecting the unpressurized fluid reservoir 50 to the hydraulic pump 15 is a hydraulic pump input line 60. Hydraulic pump input line 60 conveys the unpressurized hydraulic fluid from the unpressurized fluid reservoir 50 to the hydraulic pump where it may be pressurized and pumped downstream to operate downstream wellbore equipment as described above. The hydraulic pump input line 60 is an optional component and in some examples, the unpressurized fluid reservoir 50 may be directly coupled to the hydraulic pump without any intervening lines or separate connecting components. The hydraulic pump input line 60 may comprise any conduit configured to convey hydraulic fluid from the unpressurized fluid reservoir 50 to the hydraulic pump 15. The hydraulic pump input line 60 should be manufactured such that it can sufficiently resist external pressure and be capable of conveying hydraulic fluid from the unpressurized fluid reservoir 50 to the hydraulic pump 15. In some examples, which are discussed in greater detail below, the hydraulic pump input line 60 may be eliminated from the control systems described herein and the unpressurized fluid reservoir 50 may be directly coupled to and fluidically connected with the hydraulic pump 15 without an intervening line or other separate connecting component.

It should be clearly understood that the example system illustrated by FIG. 1 is merely a general application of the principles of this disclosure in practice, and a wide variety of other examples are possible. Therefore, the scope of this disclosure is not limited in any manner to the details of FIG. 1 as described herein.

Figure 2:
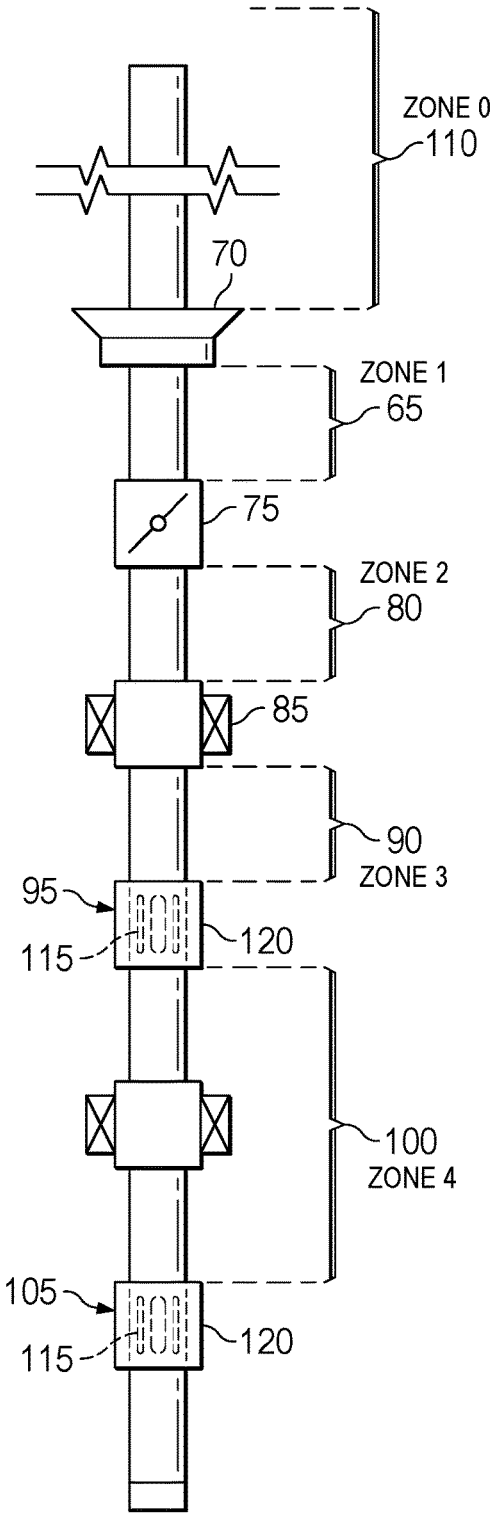
FIG. 2 is a schematic of various wellbore zones in accordance with one or more examples described herein.

FIG. 2 is a schematic illustrating some example wellbore zones of an example wellbore. Zone 1 of the wellbore is the interval 65 between the tubing hanger 70 and the safety valve 75. Zone 2 is the interval 80 between the safety valve 75 and the production packer 85. Zone 3 is the interval 90 between the production packer 85 and the first interval control valve 95. Zone 4 is the interval 100 between the first interval control valve 95 and the second interval control valve 105, and so on. Zone 0, represented by reference marker 110, represents everything uphole of the tubing hanger 70 including the surface of the wellsite which is outside of the wellbore. First interval control valve 95 and second interval control valve 105 are generically illustrated as having ports 115 within the tubing which may be covered/uncovered by the associated sliding sleeve 120. These valve types are to be understood to be merely exemplary and other types of control valves may be used as would be readily apparent to one of ordinary skill in the art. This description of zones is merely exemplary and differently defined and/or additional zones may be used in the wellbore as would be readily apparent to one of ordinary skill in the art. A control system (e.g., control system 5) may be installed in its entirety in any wellbore zone. Alternatively, some of the components of the control system 5 may be installed in one wellbore zone, whereas other components may be installed in a different wellbore zone. Another alternative example uses multiple control systems 5 with each, or parts or each, installed in different wellbore zones as desired.

It should be clearly understood that the example system illustrated by FIG. 2 is merely a general application of the principles of this disclosure in practice, and a wide variety of other examples are possible. Therefore, the scope of this disclosure is not limited in any manner to the details of FIG. 2 as described herein.

Figure 3:
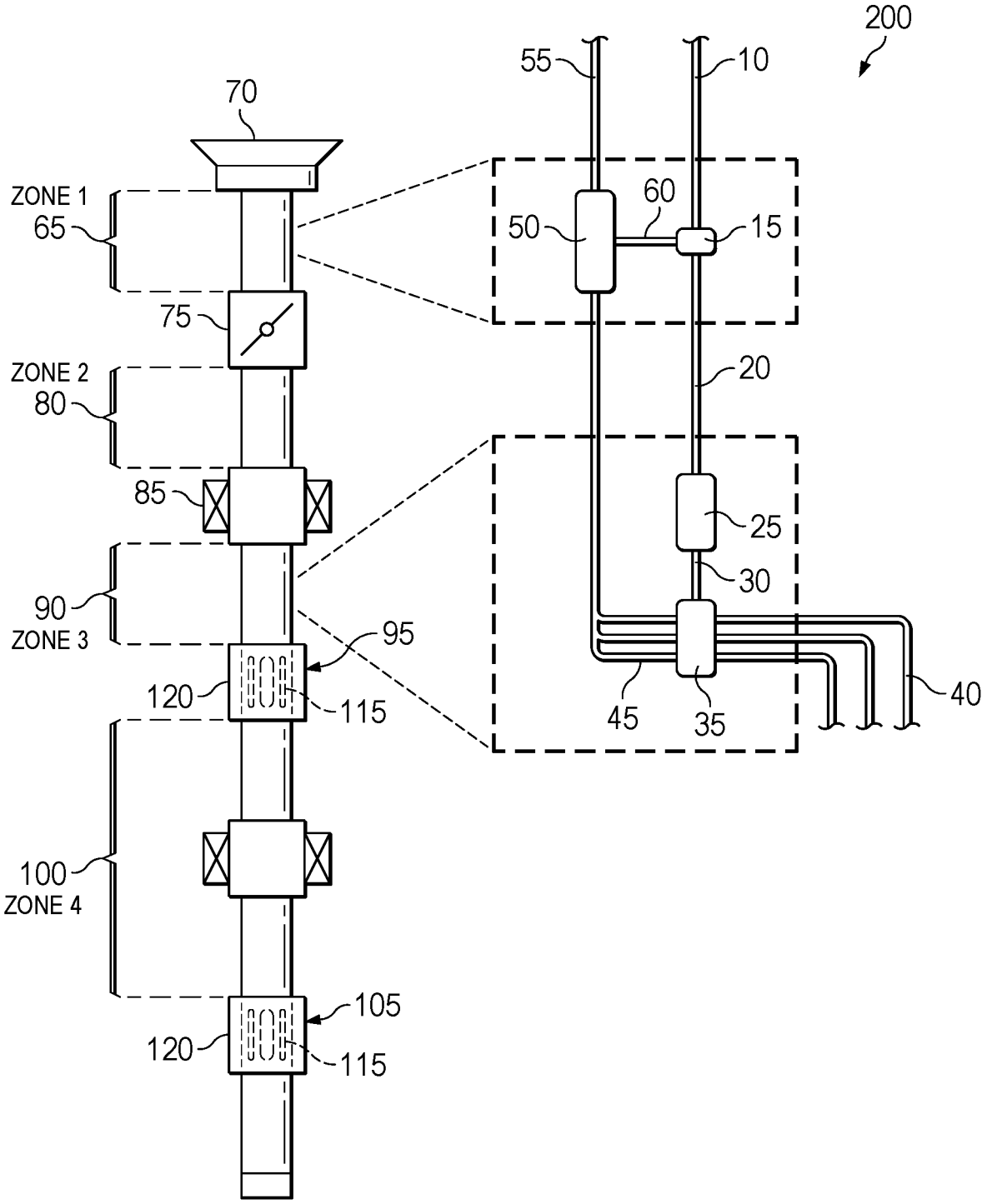
FIG. 3 is a schematic of another example of a control system in accordance with one or more examples described herein.

FIG. 3 is a schematic illustrating an example control system 200. In the illustrated example, the hydraulic pump 15 and unpressurized fluid reservoir 50 are disposed in the wellbore zone 65 between the tubing hanger 70 and the safety valve 75. The tubing encapsulated conductor 10 and the hydraulic fluid replenishment line 55 descend from the surface and are connected to the hydraulic pump 15 and the unpressurized fluid reservoir 50 respectively. The accumulator 25, the high pressure output line 30, and the valve bank 35 are disposed in a different and further downstream zone 90 located between the production packer 85 and the first interval control valve 95. The high pressure output line 20 traverses the wellbore zone 80 to fluidically connect the hydraulic pump 15 to the accumulator 25 across this span of wellbore zones. The same is done by exhaust line 45 which also traverses the wellbore zone 80 to fluidically connect the valve bank 35 and the unpressurized fluid reservoir 50. Control system 200 illustrates an example control system where the system components are divided into groupings and disposed in different wellbore zones. The control lines 40 descend downstream past wellbore zone 90 to connect to downstream wellbore equipment located further downhole in the wellbore.

It should be clearly understood that the example system illustrated by FIG. 3 is merely a general application of the principles of this disclosure in practice, and a wide variety of other examples are possible. Therefore, the scope of this disclosure is not limited in any manner to the details of FIG. 3 as described herein.

Figure 4:
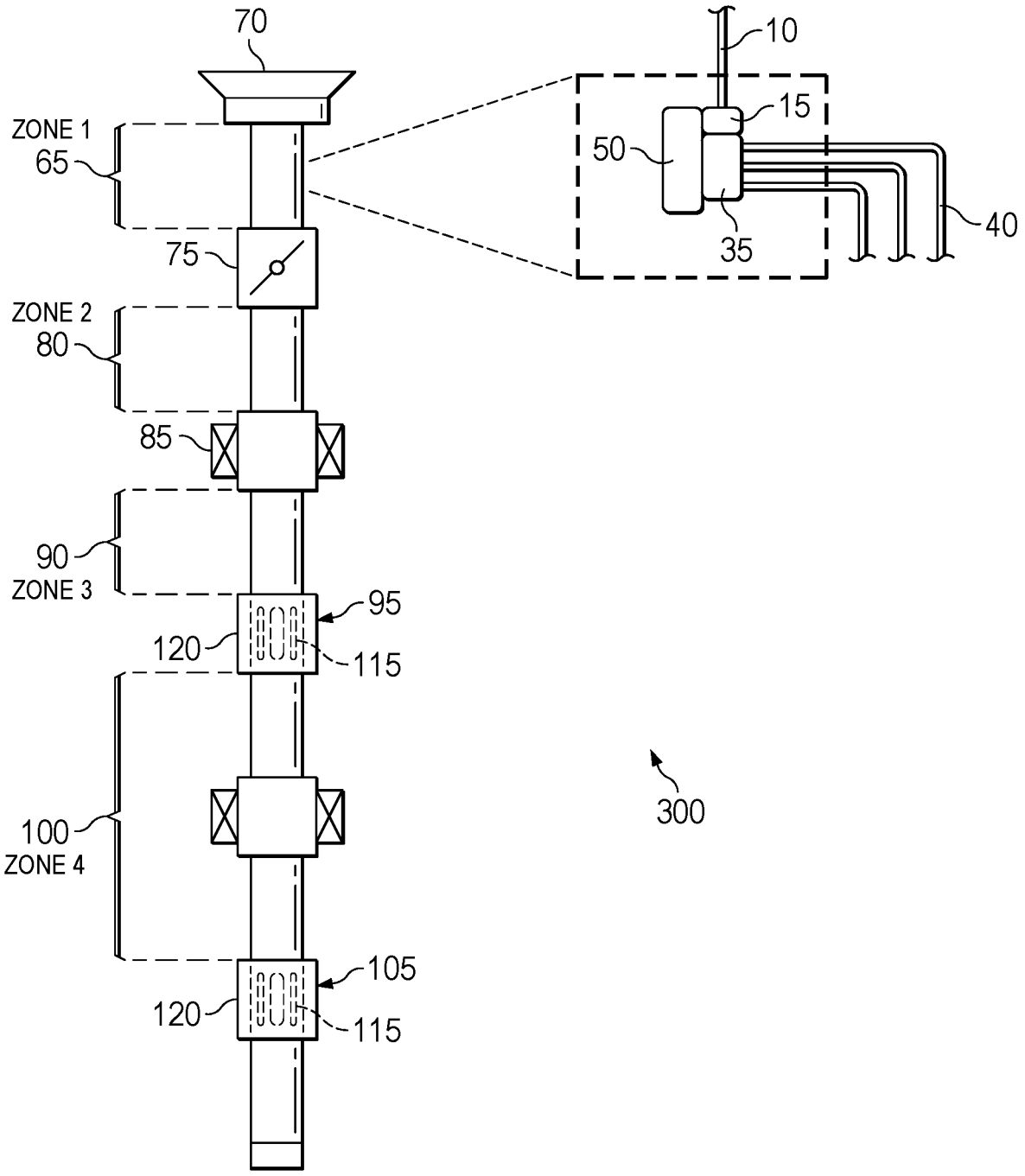
FIG. 4 is a schematic of another example of a control system in accordance with one or more examples described herein.

FIG. 4 is a schematic illustrating an example control system 300. In the illustrated example, the hydraulic pump 15, the valve bank 35, and the unpressurized fluid reservoir 50 are all disposed in the wellbore zone 65 between the tubing hanger 70 and the safety valve 75. The tubing encapsulated conductor 10 descends from the surface and is connected to the hydraulic pump 15 as discussed above. Absent from the control system 300 are the high pressure output lines (i.e., 20 and 30 as illustrated in FIGS. 1 and 3), the accumulator (i.e., 25 as illustrated in FIGS. 1 and 3), the exhaust line (i.e., 45 as illustrated in FIGS. 1 and 3), hydraulic fluid replenishment line (i.e., 55 as illustrated in FIGS. 1 and 3), and the hydraulic pump input line (i.e., 60 as illustrated in FIGS. 1 and 3). Instead the hydraulic pump 15, the valve bank 35, and the unpressurized fluid reservoir 50 are all directly coupled to and fluidically connected with one another without any intervening lines or separate connecting components. The control lines 40 are coupled to the valve bank 35 and descend further downhole past the wellbore zone 65 to connect to downstream wellbore equipment located further downhole in the wellbore. In this example, the hydraulic fluid travels directly from the hydraulic pump 15 to the valve bank 35 and then to the unpressurized fluid reservoir 50, from which it is flowed back to the hydraulic pump 15. As control system 300 does not possess intervening lines or separate connecting components, it can be easily deployed as one single unit in the wellbore.

It should be clearly understood that the example system illustrated by FIG. 4 is merely a general application of the principles of this disclosure in practice, and a wide variety of other examples are possible. Therefore, the scope of this disclosure is not limited in any manner to the details of FIG. 4 as described herein.

Figure 5:
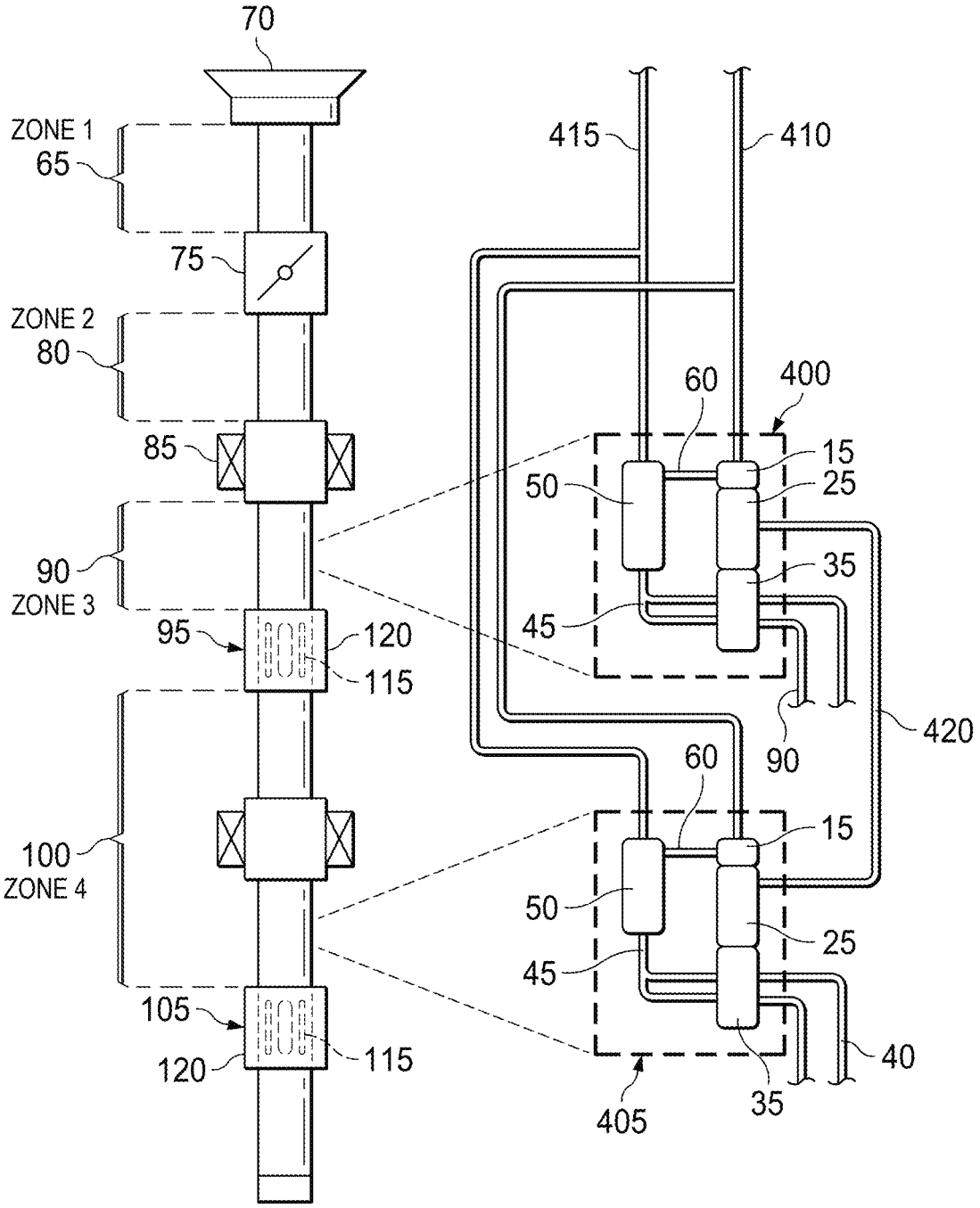
FIG. 5 is a schematic of another example of a control system in accordance with one or more examples described herein.

FIG. 5 is a schematic illustrating two control systems 400 and 405. Control system 400 comprises hydraulic pump 15, accumulator 25, valve bank 35, control lines 40, exhaust lines 45, unpressurized fluid reservoir 50, and hydraulic pump input line 60. Absent from the control system 400 are the high pressure output lines (i.e., 20 and 30 as illustrated in FIGS. 1 and 3). Instead the hydraulic pump 15, the accumulator 25, and the valve bank 35 are all directly coupled to and fluidically connected with one another without any intervening lines or separate connecting components. In this example, the hydraulic fluid travels directly from the hydraulic pump 15 to the accumulator 25 and then directly to the valve bank 35. The control lines 40 are coupled to the valve bank 35 and descend further downstream past to connect to downstream wellbore equipment located further downhole in the wellbore. Control system 405 is identical to control system 400 except that control system 405 is disposed downhole of the control system 400 and is located in a wellbore zone 100 located between the first interval control valve 95 and the second interval control valve 105, whereas the control system 400 is disposed uphole of the control system 405 in a wellbore zone 90 located between the production packer 85 and the first interval control valve 95. Additionally, the tubing encapsulated conductor 410 descends from the surface and is connected directly to each of the hydraulic pumps 15 of the control systems 400 and 405. A hydraulic fluid replenishment line 415 also descends from the surface, an uphole vessel, or an uphole reservoir and connects directly to each of the unpressurized fluid reservoirs 50 of the control systems 400 and 405. Lastly, the accumulator connecting line 420 connects and synchronizes each of the accumulators 25 of the control systems 400 and 405. As the fluid volumes in the accumulators 25 can be equalized via the transference of hydraulic fluid from the accumulator connecting line 420, the respective control systems 400 and 405 may be synchronized as desired to provide a predetermined amount of hydraulic fluid to their respective valve banks 35 when needed. The example illustrated by FIG. 5 may provide increased power, speed, and redundancy compared to the other examples described herein.

It should be clearly understood that the example system illustrated by FIG. 5 is merely a general application of the principles of this disclosure in practice, and a wide variety of other examples are possible. Therefore, the scope of this disclosure is not limited in any manner to the details of FIG. 5 as described herein.

Figure 6:
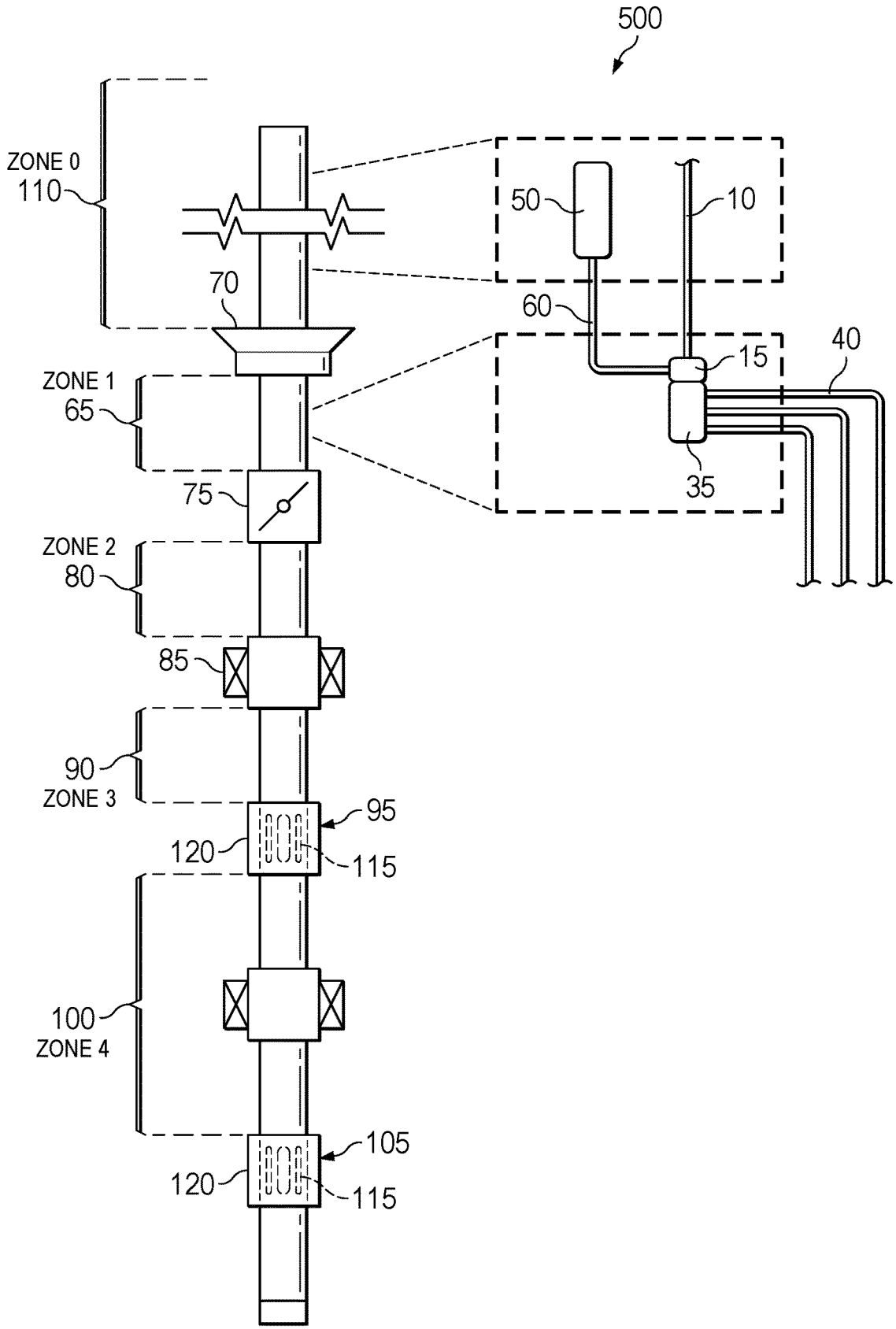
FIG. 6 is a schematic of another example of a control system in accordance with one or more examples described herein.

FIG. 6 is a schematic illustrating an example control system 500. In the illustrated example, the hydraulic pump 15 and the valve bank 35 are disposed in the wellbore zone 65 located between the tubing hanger 70 and the safety valve 75. The tubing electrical conductor 10 descends from the surface and is connected to the hydraulic pump 15 as discussed above. Absent from the control system 500 are the high pressure output lines (i.e., 20 and 30 as illustrated in FIGS. 1 and 3), the accumulator (i.e., 25 as illustrated in FIGS. 1 and 3), the exhaust line (i.e., 45 as illustrated in FIGS. 1 and 3), and the hydraulic fluid replenishment line (i.e., 55 as illustrated in FIGS. 1 and 3). Instead, the hydraulic pump 15 and the valve bank 35 are directly coupled to and fluidically connected with one another without any intervening lines or separate connecting components. The control lines 40 are coupled to the valve bank 35 and descend downstream further past wellbore zone 65 to connect to downstream wellbore equipment located further downhole in the wellbore. In this example, the hydraulic fluid travels directly from the hydraulic pump 15 to the valve bank 35, from which it is flowed to any downstream wellbore equipment via control lines 40. The unpressurized fluid reservoir 50 is disposed in Zone 0, interval 110, and is disposed uphole of the wellbore zone 1, reference marker 65, and may also be disposed on the surface of the wellsite outside of the wellbore for some examples. Optionally, a hydraulic fluid replenishment line (not illustrated) may provide fluid to the unpressurized fluid reservoir 50. Alternatively, if the unpressurized fluid reservoir 50 is on the surface, it may simply be opened and filled with hydraulic fluid at the surface.

It should be clearly understood that the example system illustrated by FIG. 6 is merely a general application of the principles of this disclosure in practice, and a wide variety of other examples are possible. Therefore, the scope of this disclosure is not limited in any manner to the details of FIG. 6 as described herein.

Figure 7:
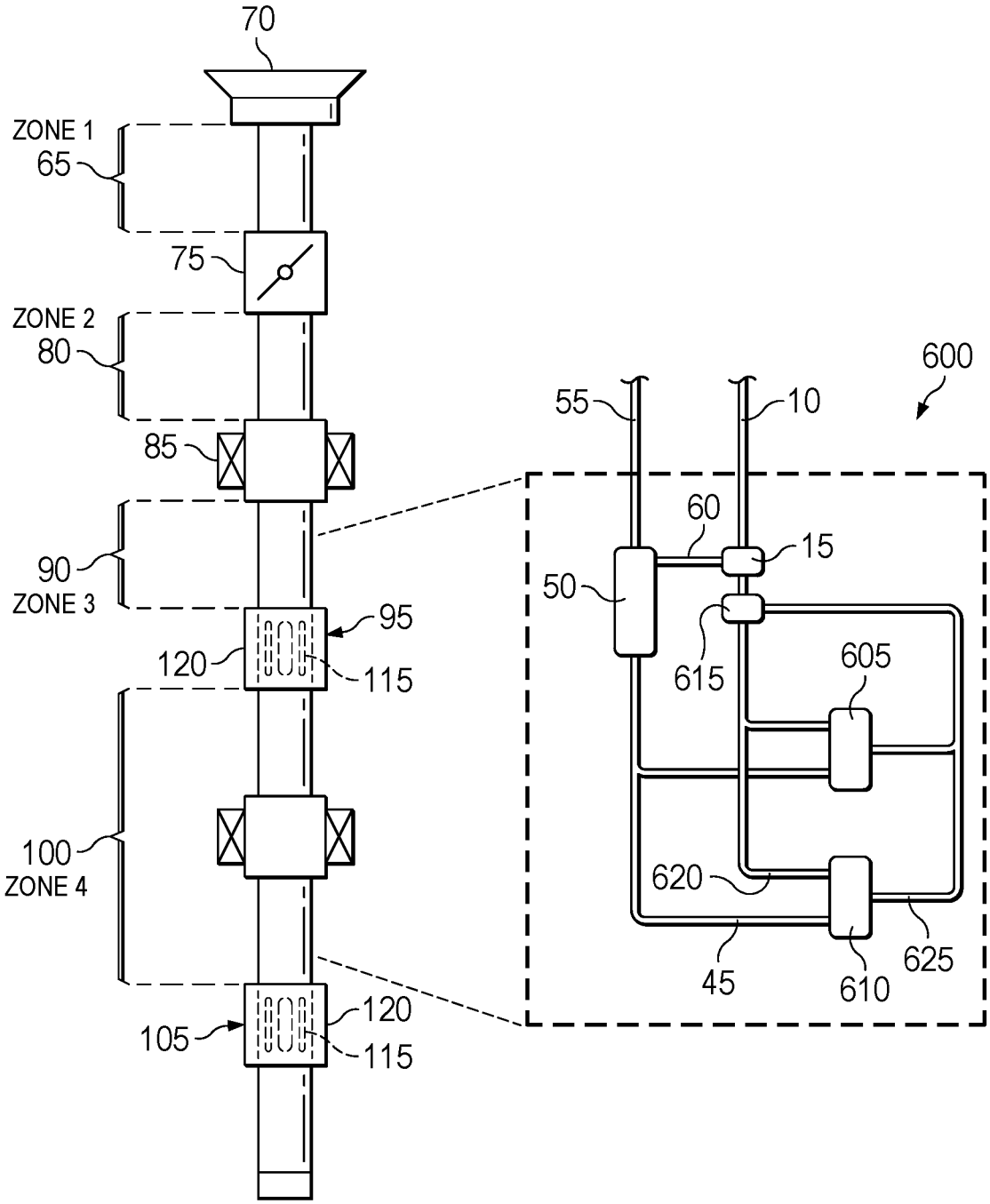
FIG. 7 is a schematic of another example of a control system in accordance with one or more examples described herein.

FIG. 7 is a schematic illustrating an example control system 600. In the illustrated example, the hydraulic pump 15, a first valve bank 605, and the unpressurized fluid reservoir 50 are all disposed in the wellbore zone 90 located between the production packer 85 and a first interval control valve 95. The tubing encapsulated conductor 10 descends from the surface and is connected to the hydraulic pump 15 as discussed above. Absent from the control system 600 are the high pressure output lines (i.e., 20 and 30 as illustrated in FIGS. 1 and 3) and the accumulator (i.e., 25 as illustrated in FIGS. 1 and 3). In the illustrated example, the first valve bank 605 is directly coupled to and fluidically connected with the first interval control valve 95. A second valve bank 610 is directly coupled to and fluidically connected with a second interval control valve 105. High pressure control lines 620 flow pressurized hydraulic fluid from the hydraulic pump 15 to the first valve bank 605 and the second valve bank 610 to operate the interval control valves 95 and 105 respectively. Low pressure control lines 625 flow pressurized hydraulic fluid from the hydraulic pump 15 to the first valve bank 605 and the second valve bank 610 to operate the interval control valves 95 and 105 respectively. The low pressure control lines 625 flow a lower pressure hydraulic fluid than the high pressure control lines 620. Using hydraulic fluid of differing pressures may allow for more operational control for an operator as they can selectively operate the valves based on the pressure threshold exceeded from the varying pressurized hydraulic fluids. For example, the operator may selectively open the first interval control valve 95 while selectively closing the second interval control valve 105. High pressure control lines 620 and low pressure control lines 625 also function as accumulators to store the pressurized hydraulic fluid until use by one of the two valve banks 605 and 610. The line switcher 615 allows the exiting pressurized hydraulic fluid from the hydraulic pump 15 to flow to either the high pressure control lines 620 or the low pressure control lines 625 as desired. Exhaust lines 45 flow vented hydraulic fluid from the two valve banks 605 and 610 to the unpressurized fluid reservoir 50 as described above. The unpressurized fluid reservoir 50 may then supply the hydraulic pump 15 with unpressurized hydraulic fluid via the hydraulic pump input line 60.

It should be clearly understood that the example system illustrated by FIG. 7 is merely a general application of the principles of this disclosure in practice, and a wide variety of other examples are possible. Therefore, the scope of this disclosure is not limited in any manner to the details of FIG. 7 as described herein.

The control systems disclosed herein may directly or indirectly affect one or more components or pieces of equipment associated with or which may come into contact with the controls systems such as, but not limited to, wellbore casing, wellbore liner, completion string, insert strings, drill string, coiled tubing, slickline, wireline, drill pipe, drill collars, mud motors, downhole motors and/or pumps, cement pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like.

Provided are control systems for operating wellbore equipment in accordance with the disclosure and the illustrated FIGs. An example control system comprises a hydraulic pump disposed in a wellbore, a valve bank disposed in the wellbore, and an unpressurized hydraulic fluid reservoir. The hydraulic pump is fluidically connected with the valve bank. The valve bank is fluidically connected with the unpressurized hydraulic fluid reservoir. The unpressurized hydraulic fluid reservoir is fluidically connected with the hydraulic pump. The control system is configured to flow pressurized hydraulic fluid exiting from the hydraulic pump to the valve bank to be distributed from the valve bank to the wellbore equipment.

Additionally or alternatively, the control system may include one or more of the following features individually or in combination. The hydraulic pump may be directly connected to the valve bank without any intervening lines or separate connecting components. The valve bank may be directly connected to the unpressurized fluid reservoir without any intervening lines or separate connecting components. The unpressurized fluid reservoir may be directly connected to the hydraulic pump without any intervening lines or separate connecting components. An accumulator may be fluidically connected to the hydraulic pump and the valve bank and the accumulator is configured to store pressurized hydraulic fluid from the hydraulic pump. A first output line may connect the hydraulic pump to the accumulator. A second output line may connect the accumulator to the valve bank. An exhaust line may connect the valve bank to the unpressurized fluid reservoir. A hydraulic fluid input line may connect the unpressurized hydraulic fluid reservoir to the hydraulic pump. The unpressurized fluid reservoir and the hydraulic pump may be disposed in a first wellbore zone between a tubing hanger and a safety valve. The accumulator and the valve bank may be disposed in a second wellbore zone between a production packer and an interval control valve. The first output line may traverse at least a third wellbore zone to connect the hydraulic pump to the accumulator. The exhaust line may traverse at least the third wellbore zone to connect the unpressurized fluid reservoir to the valve bank. The unpressurized fluid reservoir may be disposed uphole of the hydraulic pump. The unpressurized fluid reservoir may be disposed on a surface of the earth. The valve bank may be a first valve bank and the control system may comprise a second valve bank. The first valve bank may be directly coupled to and fluidically connected to a first wellbore valve. The second valve bank may be directly coupled to and fluidically connected to a second wellbore valve. A first output line may fluidically connect the hydraulic pump to the first valve bank. A second output line may fluidically connect the hydraulic pump to the first valve bank. A pressure of the pressurized hydraulic fluid in the first output line may be different from a pressure of the pressurized hydraulic fluid in the second output line. A third output line may fluidically connect the hydraulic pump to the second valve bank. A fourth output line may fluidically connect the hydraulic pump to the second valve bank. A pressure of the pressurized hydraulic fluid in the third output line may be different from a pressure of the pressurized hydraulic fluid in the fourth output line.

Provided are methods for operating wellbore equipment in accordance with the disclosure and the illustrated FIGs. An example method comprises providing a control system comprising: a hydraulic pump, a valve bank, and an unpressurized hydraulic fluid reservoir. The hydraulic pump is fluidically connected with the valve bank. The valve bank is fluidically connected with the unpressurized hydraulic fluid reservoir. The unpressurized hydraulic fluid reservoir is fluidically connected with the hydraulic pump. The method further comprises flowing pressurized hydraulic fluid exiting from the hydraulic pump to the valve bank and distributing the pressurized hydraulic fluid from the valve bank to the wellbore equipment.

Additionally or alternatively, the method may include one or more of the following features individually or in combination. The method may further comprise blocking in the pressure to the wellbore equipment by sealing a valve in the valve bank through which the pressurized hydraulic fluid is distributed to the wellbore equipment and the blocking in the pressure to the wellbore equipment may occur after the pressurized hydraulic fluid is distributed to the wellbore equipment. The method may further comprise venting hydraulic fluid to the unpressurized fluid reservoir from the valve bank. The method may further comprise distributing pressurized hydraulic fluid to at least two different pieces of wellbore equipment. The hydraulic pump may be directly connected to the valve bank without any intervening lines or separate connecting components. The valve bank may be directly connected to the unpressurized fluid reservoir without any intervening lines or separate connecting components. The unpressurized fluid reservoir may be directly connected to the hydraulic pump without any intervening lines or separate connecting components. An accumulator may be fluidically connected to the hydraulic pump and the valve bank and the accumulator is configured to store pressurized hydraulic fluid from the hydraulic pump. A first output line may connect the hydraulic pump to the accumulator. A second output line may connect the accumulator to the valve bank. An exhaust line may connect the valve bank to the unpressurized fluid reservoir. A hydraulic fluid input line may connect the unpressurized hydraulic fluid reservoir to the hydraulic pump. The unpressurized fluid reservoir and the hydraulic pump may be disposed in a first wellbore zone between a tubing hanger and a safety valve. The accumulator and the valve bank may be disposed in a second wellbore zone between a production packer and an interval control valve. The first output line may traverse at least a third wellbore zone to connect the hydraulic pump to the accumulator. The exhaust line may traverse at least the third wellbore zone to connect the unpressurized fluid reservoir to the valve bank. The unpressurized fluid reservoir may be disposed uphole of the hydraulic pump. The unpressurized fluid reservoir may be disposed on a surface of the earth. The valve bank may be a first valve bank and the control system may comprise a second valve bank. The first valve bank may be directly coupled to and fluidically connected to a first wellbore valve. The second valve bank may be directly coupled to and fluidically connected to a second wellbore valve. A first output line may fluidically connect the hydraulic pump to the first valve bank. A second output line may fluidically connect the hydraulic pump to the first valve bank. A pressure of the pressurized hydraulic fluid in the first output line may be different from a pressure of the pressurized hydraulic fluid in the second output line. A third output line may fluidically connect the hydraulic pump to the second valve bank. A fourth output line may fluidically connect the hydraulic pump to the second valve bank. A pressure of the pressurized hydraulic fluid in the third output line may be different from a pressure of the pressurized hydraulic fluid in the fourth output line.

Provided are systems for operating wellbore equipment in a wellbore in accordance with the disclosure and the illustrated FIGs. An example system comprises a control system comprising a hydraulic pump, a valve bank, and an unpressurized hydraulic fluid reservoir. The hydraulic pump may be fluidically connected with the valve bank. The valve bank may be fluidically connected with the unpressurized hydraulic fluid reservoir. The unpressurized hydraulic fluid reservoir may be fluidically connected with the hydraulic pump. The control system may be configured to flow pressurized hydraulic fluid exiting from the hydraulic pump to the valve bank to be distributed from the valve bank to the wellbore equipment. The system further comprises a wellbore tubing and the control system is deployed on the wellbore tubing.

Additionally or alternatively, the system may include one or more of the following features individually or in combination. The control system may be a first control system. The first control system may be disposed in a first wellbore zone located between a production packer and an interval control valve. The system may comprise a second control system disposed in a second wellbore zone different from the first wellbore zone. The second control system may be identical to the first control system. The interval control valve may be a first interval control valve and the second wellbore zone may be disposed between the first interval control valve and a second interval control valve. The first control system and the second control system may each comprise an accumulator and the accumulator of the first control system may be fluidically connected to the accumulator of the second control system. The system may further comprise a hydraulic fluid replenishment line descending from the surface and fluidically connected to the unpressurized fluid reservoir. The hydraulic pump may be directly connected to the valve bank without any intervening lines or separate connecting components. The valve bank may be directly connected to the unpressurized fluid reservoir without any intervening lines or separate connecting components. The unpressurized fluid reservoir may be directly connected to the hydraulic pump without any intervening lines or separate connecting components. An accumulator may be fluidically connected to the hydraulic pump and the valve bank and the accumulator is configured to store pressurized hydraulic fluid from the hydraulic pump. A first output line may connect the hydraulic pump to the accumulator. A second output line may connect the accumulator to the valve bank. An exhaust line may connect the valve bank to the unpressurized fluid reservoir. A hydraulic fluid input line may connect the unpressurized hydraulic fluid reservoir to the hydraulic pump. The unpressurized fluid reservoir and the hydraulic pump may be disposed in a first wellbore zone between a tubing hanger and a safety valve. The accumulator and the valve bank may be disposed in a second wellbore zone between a production packer and an interval control valve. The first output line may traverse at least a third wellbore zone to connect the hydraulic pump to the accumulator. The exhaust line may traverse at least the third wellbore zone to connect the unpressurized fluid reservoir to the valve bank. The unpressurized fluid reservoir may be disposed uphole of the hydraulic pump. The unpressurized fluid reservoir may be disposed on a surface of the earth. The valve bank may be a first valve bank and the control system may comprise a second valve bank. The first valve bank may be directly coupled to and fluidically connected to a first wellbore valve. The second valve bank may be directly coupled to and fluidically connected to a second wellbore valve. A first output line may fluidically connect the hydraulic pump to the first valve bank. A second output line may fluidically connect the hydraulic pump to the first valve bank. A pressure of the pressurized hydraulic fluid in the first output line may be different from a pressure of the pressurized hydraulic fluid in the second output line. A third output line may fluidically connect the hydraulic pump to the second valve bank. A fourth output line may fluidically connect the hydraulic pump to the second valve bank. A pressure of the pressurized hydraulic fluid in the third output line may be different from a pressure of the pressurized hydraulic fluid in the fourth output line.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A control system for operating wellbore equipment, the control system comprises:

a hydraulic pump disposed in a wellbore, a valve bank disposed in the wellbore, a hydraulic fluid reservoir; wherein the hydraulic pump is fluidically connected with the valve bank; wherein the valve bank is fluidically connected with the hydraulic fluid reservoir; wherein the hydraulic fluid reservoir is fluidically connected with the hydraulic pump; wherein the control system is configured to flow pressurized hydraulic fluid exiting from the hydraulic pump to the valve bank to be distributed from the valve bank to the wellbore equipment, an accumulator fluidically connected to the hydraulic pump and the valve bank and the accumulator is configured to store pressurized hydraulic fluid from the hydraulic pump;

wherein a first output line connects the hydraulic pump to the accumulator; wherein a second output line connects the accumulator to the valve bank; wherein an exhaust line connects the valve bank to the hydraulic fluid reservoir; and wherein a hydraulic fluid input line connects the hydraulic fluid reservoir to the hydraulic pump; and wherein the hydraulic fluid reservoir and the hydraulic pump are disposed in a first wellbore zone between a tubing hanger and a safety valve; wherein the accumulator and the valve bank are disposed in a second wellbore zone between a production packer and an interval control valve; wherein the first output line traverses at least a third wellbore zone to connect the hydraulic pump to the accumulator; wherein the exhaust line traverses at least the third wellbore zone to connect the hydraulic fluid reservoir to the valve bank.

2. The control system of claim 1, wherein the hydraulic fluid reservoir is disposed upstream of the hydraulic pump.

3. The control system of claim 1, wherein the valve bank is a first valve bank and wherein the control system comprises a second valve bank.

4. The control system of claim 3, wherein the first valve bank is directly coupled to and fluidically connected to a first wellbore valve; wherein the second valve bank is directly coupled to and fluidically connected to a second wellbore valve.

5. The control system of claim 4, wherein a first output line fluidically connects the hydraulic pump to the first valve bank; wherein a second output line fluidically connects the hydraulic pump to the first valve bank; wherein a pressure of the pressurized hydraulic fluid in the first output line is different from a pressure of the pressurized hydraulic fluid in the second output line; wherein a third output line fluidically connects the hydraulic pump to the second valve bank; wherein a fourth output line fluidically connects the hydraulic pump to the second valve bank; wherein a pressure of the pressurized hydraulic fluid in the third output line is different from a pressure of the pressurized hydraulic fluid in the fourth output line.

6. A method for operating wellbore equipment with a control system, the method comprises:

providing a control system comprising:

a hydraulic pump, a valve bank, a hydraulic fluid reservoir; wherein the hydraulic pump is fluidically connected with the valve bank; wherein the valve bank is fluidically connected with the hydraulic fluid reservoir; wherein the hydraulic fluid reservoir is fluidically connected with the hydraulic pump, an accumulator fluidically connected to the hydraulic pump and the valve bank and the accumulator is configured to store pressurized hydraulic fluid from the hydraulic pump;

wherein a first output line connects the hydraulic pump to the accumulator; wherein a second output line connects the accumulator to the valve bank; wherein an exhaust line connects the valve bank to the hydraulic fluid reservoir; and wherein a hydraulic fluid input line connects the hydraulic fluid reservoir to the hydraulic pump; and wherein the hydraulic fluid reservoir and the hydraulic pump are disposed in a first wellbore zone between a tubing hanger and a safety valve; wherein the accumulator and the valve bank are disposed in a second wellbore zone between a production packer and an interval control valve; wherein the first output line traverses at least a third wellbore zone to connect the hydraulic pump to the accumulator; wherein the exhaust line traverses at least the third wellbore zone to connect the hydraulic fluid reservoir to the valve bank;

flowing pressurized hydraulic fluid exiting from the hydraulic pump to the valve bank; and distributing the pressurized hydraulic fluid from the valve bank to the wellbore equipment.

7. The method of claim 6, further comprising blocking in the pressure to the wellbore equipment by sealing a valve in the valve bank through which the pressurized hydraulic fluid is distributed to the wellbore equipment; wherein the blocking in the pressure to the wellbore equipment occurs after the pressurized hydraulic fluid is distributed to the wellbore equipment.

8. The method of claim 6, further comprising venting hydraulic fluid to the hydraulic fluid reservoir from the valve bank.

9. The method of claim 6, further comprising distributing pressurized hydraulic fluid to at least two different pieces of wellbore equipment.

10. The method of claim 6, wherein the hydraulic fluid reservoir is disposed upstream of the hydraulic pump.

11. The method of claim 6, wherein the valve bank is a first valve bank and wherein the control system comprises a second valve bank.

12. The method of claim 11, wherein the first valve bank is directly coupled to and fluidically connected to a first wellbore valve; wherein the second valve bank is directly coupled to and fluidically connected to a second wellbore valve.

13. A system for operating wellbore equipment with a control system, the system comprising: a first control system comprising:

a hydraulic pump, a valve bank, a hydraulic fluid reservoir; wherein the hydraulic pump is fluidically connected with the valve bank; wherein the valve bank is fluidically connected with the hydraulic fluid reservoir; wherein the hydraulic fluid reservoir is fluidically connected with the hydraulic pump; wherein the control system is configured to flow pressurized hydraulic fluid exiting from the hydraulic pump to the valve bank to be distributed from the valve bank to the wellbore equipment;

a second control system;

wherein the first control system is disposed in a first wellbore zone located between a production packer and an interval control valve; wherein second control system is disposed in a second wellbore zone different from the first wellbore zone;

wherein the first control system and the second control system each comprise an accumulator; wherein the accumulator of the first control system is fluidically connected to the accumulator of the second control system; and a wellbore tubing; wherein the first control system is deployed on the wellbore tubing.

14. The system of claim 13; wherein the second control system is identical to the first control system.

15. The system of claim 13; wherein the interval control valve is a first interval control valve and the second wellbore zone is disposed between the first interval control valve and a second interval control valve.

16. The system of claim 13, further comprising a hydraulic fluid replenishment line descending from the surface and fluidically connected to the hydraulic fluid reservoir.

* * * * *